United States Patent [19]

Muehling

[11] 4,276,799

[45] Jul. 7, 1981

[54] POWER TOOL APPARATUS

[75] Inventor: Anthony A. Muehling, Detroit, Mich.

[73] Assignee: Black & Decker Inc., Newark, Del.

[21] Appl. No.: 31,271

[22] Filed: Apr. 18, 1979

[51] Int. Cl.[3] ..... B27B 5/24

[52] U.S. Cl. ..... 83/473; 83/477.1; 83/477.2

[58] Field of Search ..... 83/473, 477.1, 477.2, 83/471.3

[56] References Cited

U.S. PATENT DOCUMENTS

| | | | |
|---|---|---|---|
| 366,633 | 7/1887 | Mackintosh | 83/473 |
| 1,679,103 | 7/1928 | Thomson | 83/477.1 |
| 2,704,560 | 3/1955 | Woessner | 83/473 |
| 2,719,547 | 10/1955 | Gjerde | 83/473 |
| 2,850,054 | 7/1956 | Eschenburg | 83/473 |
| 2,852,047 | 9/1958 | Odlum et al. | 83/473 |
| 2,873,773 | 2/1959 | Gaskell | 83/473 |
| 2,945,516 | 7/1960 | Edgemond, Jr. et al. | 83/473 |
| 3,280,861 | 10/1966 | Gjerde | 83/473 |
| 3,386,482 | 6/1968 | Nadeau | 83/477.1 |
| 3,670,788 | 6/1972 | Pollak et al. | 83/508.2 |

FOREIGN PATENT DOCUMENTS 1503925 11/1969 Fed. Rep. of Germany .

*Primary Examiner*—Frank T. Yost

*Attorney, Agent, or Firm*—Leonard Bloom; Edward Murphy; Harold Weinstein

[57] ABSTRACT

The invention is directed to a power tool apparatus such as a table saw which includes a housing having a table top with an appropriate opening for a motor driven tool. Pivotally mounted within the housing is an assembly which in the disclosed embodiment includes a frame having a subassembly pivotally mounted therein. A subassembly includes the tool, such as a saw blade, and the means for driving same. A first control includes a lever connected to the subassembly for pivoting same. The pivotal movement effected by the lever allows for quick and coarse setting of the tool at a desired elevation with respect to the tabletop. The control lever further includes a locking arrangement disposed thereon which is manipulatable by the same hand used to coarsely set the tool elevation. The locking arrangement secures the lever to the frame at the desired coarse setting.

A second control means likewise operable by the same hand of the operator, is connected to the subassembly, whereby the subassembly is pivoted independently of the first control. This second control provides a vernier adjustment of the tool. The assembly can be pivoted about its pivot mount in the housing in order to change the relative angle of the tool to the tabletop so that bevel cuts can be made.

53 Claims, 14 Drawing Figures

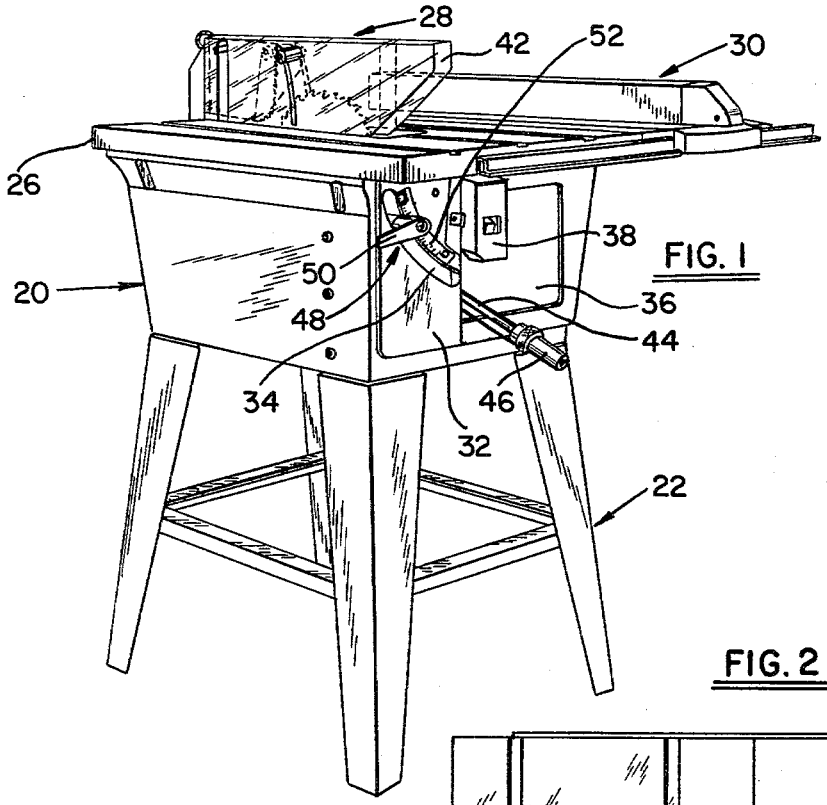
FIG. 1
FIG. 2
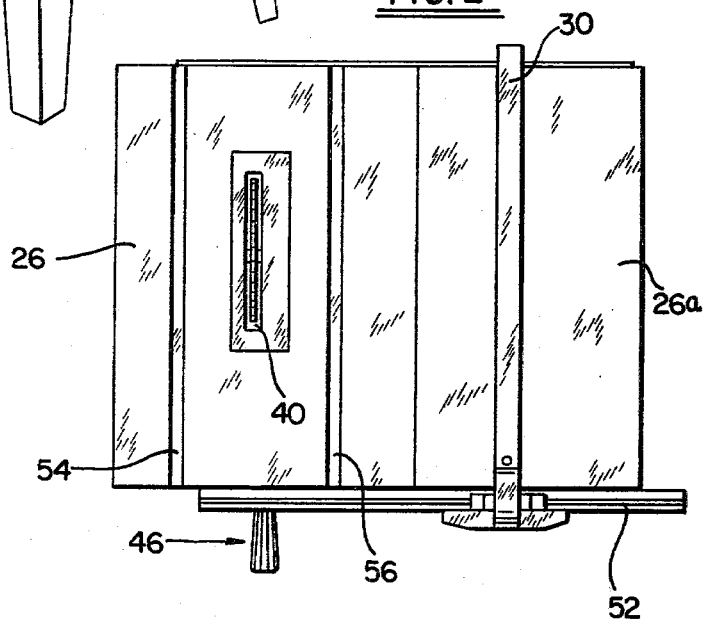
FIG. 14
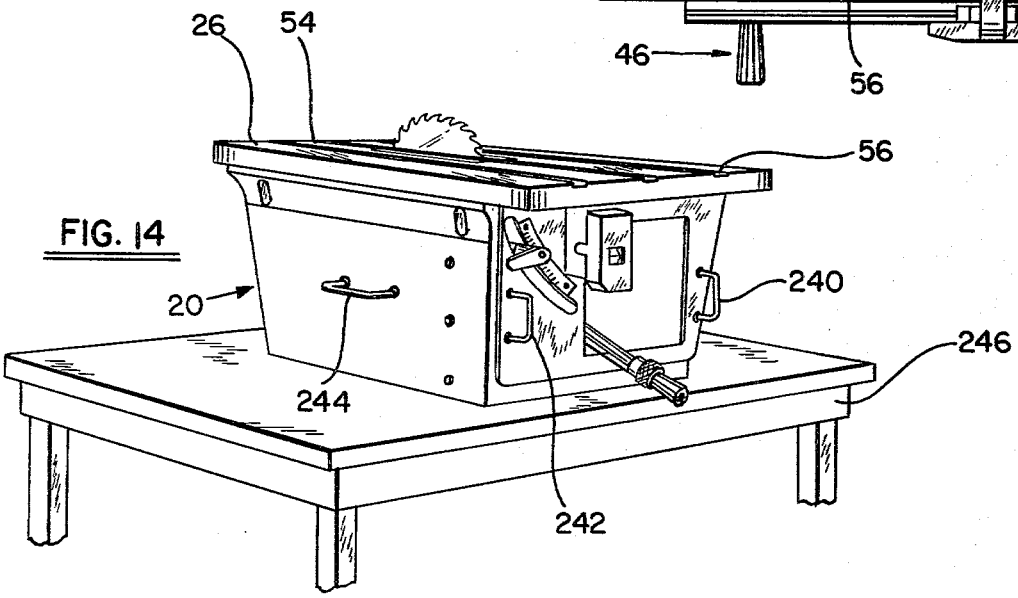

POWER TOOL APPARATUS

FIELD OF THE INVENTION

This invention relates generally to a power tool apparatus and related method, and more particularly to a multi-purpose, coarse and finely adjustable rotating tool, which performs a variety of operations on wood, metal or the like.

BACKGROUND OF THE INVENTION

Elevating and tilting mechanisms of the general nature described hereinafter have typically employed worm screw arrangements. Such units are described in U.S. Pat. Nos. 2,850,054, 2,852,047 and 2,873,773. Although these units provide for an accurate setting of the tool in relation to the table top, the time necessary for the operator to arrive at the required tool elevation and bevel angle is often times unduly lengthy.

Further, these type mechanisms are generally intricately machined, and thus expensive, cumbersome and typically not conducive for on-site work by contractors or available for the homeowner for use around the house.

Rapid-set, lever-operated, elevating and tilting devices are also known. See, for example, U.S. Pat. Nos. 2,704,560; 2,719,547 and 3,670,788. Although the units described in the aforementioned patents have lever-operated arrangements, none of those cited above disclose a locking mechanism which can be manipulated by the same hand of the operator used to set the elevation of the blade. Further, none of those identified, suggest the inclusion of a vernier adjustment of the tool.

Finally, applicant is aware of a table saw presently marketed overseas, which includes a lever-operated, elevating mechanism having means for locking the lever to the housing at the desired blade elevation setting. Further, this table saw includes a vernier adjust feature which is disposed on the lever and activated through rotation of the lever grip.

The table saw also includes means for varying the angular relationship between the tool and the work surface. However, in this table saw, it is the work surface table portion thereof which is pivotally mounted on the housing. The fact that the work surface tilts, limits the application of such a machine in that relatively long pieces of lumber and the like can't be cut at larger bevel angles because the floor on which the table saw stands, acts as an obstruction. This generally precludes application of such a device to on-site work by the small contractor or homeowner and, hence, limits its general application.

It is, therefore, a primary object of this invention to provide a power tool apparatus which allows for one-hand, coarse and vernier adjustment of the tool elevation setting and which further provides a lever-operated, tilt mechanism wherein the tool support assembly is pivoted relative to a stationary, horizontal work surface.

It is still a further object of this invention to provide a power tool apparatus which achieves the accuracy of worm gear type units, but which provides quick setting of the elevation angle of the tool.

It is yet another object of this invention to provide a locking mechanism, disposed on the elevation setting lever, which is manipulated by the same hand.

It is yet a further object of this invention to provide a power tool apparatus which employs a relatively simple, vernier adjust mechanism.

It is still another object of this invention to provide a power tool apparatus which because of its relatively simple design, is mass producible at a cost which makes it readily available to the small contractor or homeowner.

It is yet another object of this invention to provide in one embodiment, a compact, portable apparatus which is aptly suited for practically all types of on-site work encountered by the small contractor or homeowner.

It is still a further object in one application of the invention to provide the above-mentioned power tool apparatus in the form of a table saw which is low cost, and which meets the needs of the small contractor or homeowner.

SUMMARY OF THE INVENTION

Towards the accomplishment of these and other objects which will become apparent from a consideration of the drawings and accompanying description, there is disclosed a power tool apparatus including a housing equipped with a table top having an opening through which a motor-driven tool can pass. Bevel angle pivot means or assembly means are provided which are pivotally mounted in the housing about a first or bevel angle pivot axis. The assembly means includes pivot means defining a second or elevation pivot axis and the pivot means is fixedly connected to the assembly means. The assembly means further includes subassembly means pivotally mounted on the pivot means and including the tool. The assembly means further includes coarse adjustment or control means comprising a control lever operatively connected to the subassembly means for pivoting same about the second pivot axis, whereby the tool is raised or lowered in the opening of the table top to a desired elevation, in a quick setting manner. The control means further includes locking means securing the control lever at a position corresponding to the desired elevation setting for the tool. The locking means are proximately disposed to the control lever, such that both are manipulatable by the same hand of the operator, without removing the hand from the lever throughout the complete elevation setting operation. Bevel angle adjustment means are provided for pivoting the assembly means about the first axis, whereby the angle of the tool relative to the tabletop is varied.

A further feature of the invention provides for vernier adjustment or second control means operatively connected to the subassembly means for pivoting the subassembly means about the second pivot axis independently of the control lever. The second control means provides a further elevation adjustment of the tool.

Yet another feature of the invention provides for the positioning of the second control means in proximate relationship to the control lever such that the second control means is manipulatable by the same hand of the operator used to quick set the tool and to lock the control lever.

Particularly described for the locking means is a split yoke disposed about the pivot means, a control rod, and a rotatable hand grip disposed upon the control lever, the control rod operatively connected between the split yoke and the rotatable hand grip such that the split yoke is secured to the pivot means when the grip is rotated in one direction and wherein the yoke is released from a secured connection to the pivot means when the grip is rotated in the opposite direction.

Still another feature of the invention provides that the second control means include a leaf spring disposed along the length of the control lever, hub means disposed at one end of the control lever and fixedly connected to one end of the leaf spring, the remaining end of the leaf spring fixedly connected to the subassembly means, and means for urging the hub means axially along the control lever arm, whereby the stress developed in the leaf spring is transmitted through its operative connection to the subassembly means to cause pivoting thereof about the second pivot axis. The means for urging are proximately disposed on the control lever so as to be manipulatable by the operator's hand.

According to yet another feature of the invention, means for easily carrying and transporting the apparatus are provided.

The invention disclosed is further directed to a method of providing for one hand, coarse and vernier elevation setting of a tool as well as bevel angle setting as implemented substantially, by the apparatus described.

BRIEF DESCRIPTION OF THE DRAWINGS

FIG. 1 is a perspective view of a preferred embodiment of the invention in the form of a table saw incorporating the principles of the invention.

FIG. 2 is a plan view of the table top of the table saw depicted in FIG. 1.

FIG. 14 is a perspective view of a portable version of the present embodiment.

DESCRIPTION OF THE PREFERRED EMBODIMENT

Figure 3:
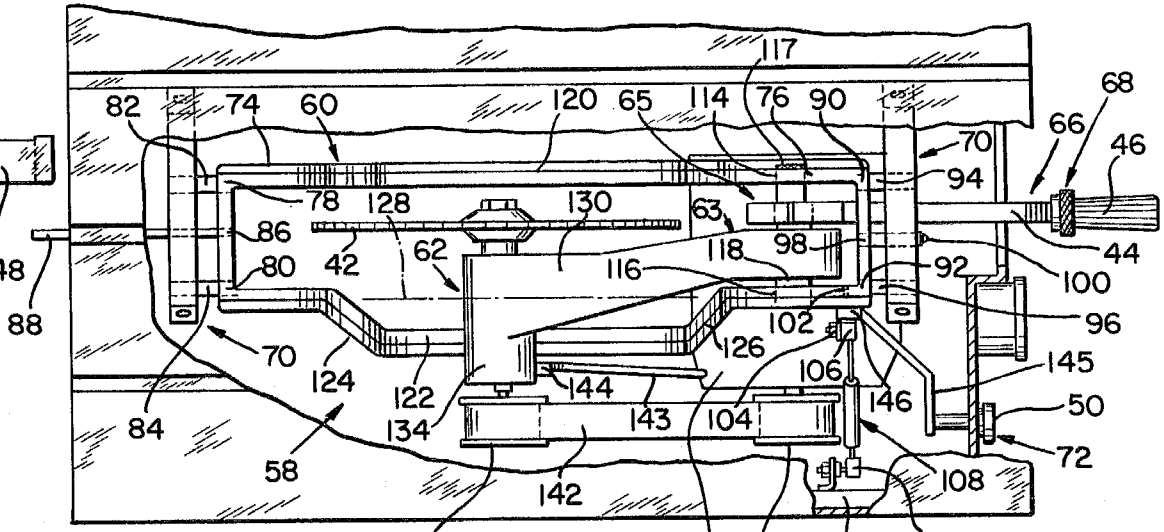
FIG. 3 is a plan view of the table saw of FIG. 1 with a portion of the table top cut away to show the assembly within.

Referring now to FIG. 1, there is shown a power tool constructed in accordance with the principles of the present invention. In the following discussion, reference to a table saw may be made alternately with that of power tool apparatus. It is to be understood that the table saw version alluded to is but one species of the present invention which has much broader application.

It is seen to include a housing 20 which is disposed upon a stand 22 and which further includes a table top section 26. (reference numeral 24 not used) The latter is secured to the top of the enclosure by suitable means.

Affixed to the housing are typical accessories for such a power tool, including a guard member 28 and a rip fence 30. The former might typically be pivotally mounted to the housing at a point below the plane of the top surface of the table top. This allows for its movement up and away from the workpiece and allows for it to drop below the plane of the top surface. This is important particularly where the cut or operation to be performed does not result in vertical thru cutting of said workpiece.

The housing 20 includes a front facing panel 32. The latter includes various openings such as arcuate slot 34 and opening 36. These openings accommodate lever arms which are used during the operation of the unit as will be described hereinafter.

Mounted on the front panel 32 is a power control box 38. This is connected to a source of electrical power (not shown) and includes a switch or other suitable means for connecting that power to the tool drive means contained inside the housing 20.

The table top includes an appropriate opening 40 (see FIG. 2) which is dimensioned and contoured to accommodate the rotating tool 42 and the bevelling feature described hereinafter.

Extending from within the housing 20 out through opening 36 is a control lever 44 which includes a rotatable hand grip 46. Extending from within the housing and out through arcuate slot 34 is the bevel angle lever 48 with suitable, rotatable locking grip 50.

Also disposed on the front panel 32 is a bevel angle scale 52 which cooperates with an appropriate pointer not readily visible, to indicate the tilt angle of the tool.

FIG. 2 as noted above is a plan view of the unit. The table top is shown as is the relationship of the rip fence 30 mounted in the fence guide 52. Extending longitudinally and parallel to the side edge of the table top are grooves 54 and 56. These accommodate mitering fixtures and the like which are employed by workmen for known purposes. The table top can include a removable extension 26 which expands the work area.

Figure 4:
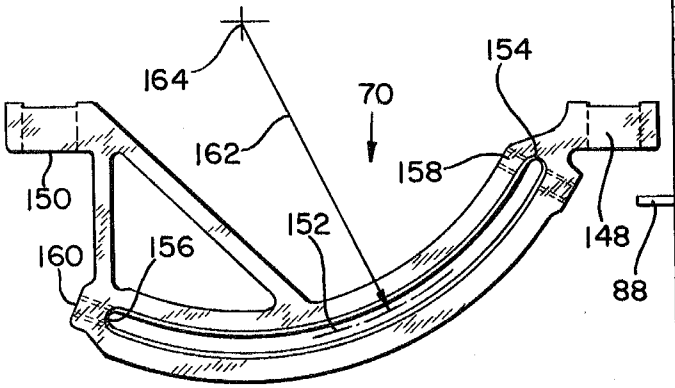
FIG. 4 is an elevation view of the mounting for the assembly portion for the invention which allows for bevel angle setting.

Referring now to FIGS. 3 and 4, the basic assembly 58 is revealed is pivotally mounted in the housing 20 about a first pivot axis. It is seen to include a frame or carriage 60 which has a first subassembly 62 pivotally mounted therein. The subassembly includes the tool 42 in the form of a saw blade. An electrical motor 64 provides the drive for the tool. It is connected to the power control box 38 in a known fashion. The motor is secured to a hub portion 63 (176 hereinafter) by a suitable mount not shown. The motor rotates with the first subassembly 62 as described hereinafter.

A second subassembly 65 pivotally mounted in the frame 60 comprises first control means 66 including the control lever 44. The second subassembly 65 is operatively connected to the first subassembly 62 in a manner to be described hereinafter.

The control means 66 includes the rotatable hand grip 46 which activates locking means for securing the control lever 44 in a manner, again, to be described hereinafter.

Second control means shown generally at 68 is operatively connected to subassembly 62. Again, the particulars of the cooperative action between this second control means 68 and the subassembly 62 will be described hereinafter.

Finally, mounting means for suspending the assembly 58 below the table top in a pivotal fashion about an axis which is preferably in the plane of the top surface of the table top and which is perpendicular to the rotational axis of the tool are shown at 70. The cooperative action between first control means 66 and means 72, for rotating and locking the assembly at a desired bevel angle will likewise be described below.

In detail, assembly 58, as noted above, includes the frame 60. The latter, typically, is a diecast aluminum piece. It includes two end sections 74 and 76 which, in the plan view of FIG. 3, are seen to be U-shaped in profile.

End section 74 includes two holes 78 and 80 for accepting guide pins 82 and 84, respectively. In the assembly of the unit, these pins typically, are press fitted into the cooperating holes. End section 74 is seen to further include a hole 86 which accepts a pin mount 88 used to support the guard and/or splitter accessory 28 (FIG. 1). The pin 88 is secured in the hole 86 by a set screw (not shown) which allows for an adjustment of the pin, in and out, as well as rotatably, to accommodate necessary variations in the location of the accessory relative to the tool and/or work piece.

Section 76 likewise is U-shaped as seen in the plan view. It includes holes 90 and 92 which accept guide pins 94 and 96, respectively. Section 76 further includes a tapped hole 98 for accepting a spring biased screw 100. The latter is employed during the assembly of the unit to preload the assembly 58 in an axial direction, front to back relative to the table top. This locates the assembly 58 between the assembly mounts 70. This technique allows for a wide tolerance range in locating the mounts, thus reducing the cost of fabrication.

One leg portion of section 76 includes tapped holes 102 for receiving screws to secure a mounting bracket 104 thereto. Connected to the bracket is end 106 of a pneumatic device 108. The connection between end 106 and the bracket 104, typically, is a ball-socket, univeral type mounting which permits rotational movement between the frame 60 and the pneumatic device 108.

End 110 of the device is mounted to side wall 112 of housing 20 by a similar ball-socket, universal type mounting.

The facilitating action of this pneumatic device 108 in pivoting the assembly 58 between bevel angle settings is the subject of a copending application. Suffice it to say for the purposes of this application, that the device 108 is a relatively recent innovation which has found major application in the auto industry. It is known as a "gas spring" and is distributed in the United States by the Gas Spring Corporation of Montgomeryville, Pennsylvania. It acts as a facilitator to the operator in setting the assembly 58 at varying bevel angles. It assists in both raising and lowering the assembly. The device is selected typically based on the so-called extending force required in its extended position. This force is a function of the weight and moment arm of the assembly at the maximum bevel angle position, as well as the friction experienced between the pins 82, 84 and 94, 96 and their respective mounting tracks to be discussed later.

Section 76 is seen to further include shaft mounting holes 114 and 116. Disposed in 114 is a pivot nut 117 which is manufactured, typically, from sintered powdered iron. The nut 117 is press-fitted into the hole 114 during assembly. The details of the cooperative relationship between the nut and the hole are discussed hereinbelow with respect to FIG. 5.

Disposed in and between the shaft mounting holes 114 and 116, is a mounting shaft 118 upon which is disposed a cooperating hub portion of the first subassembly 62. The latter is pivotally mounted on pivot means including shaft 118 defining a second pivot axis. Further discussion is set out hereinafter.

Figure 9:
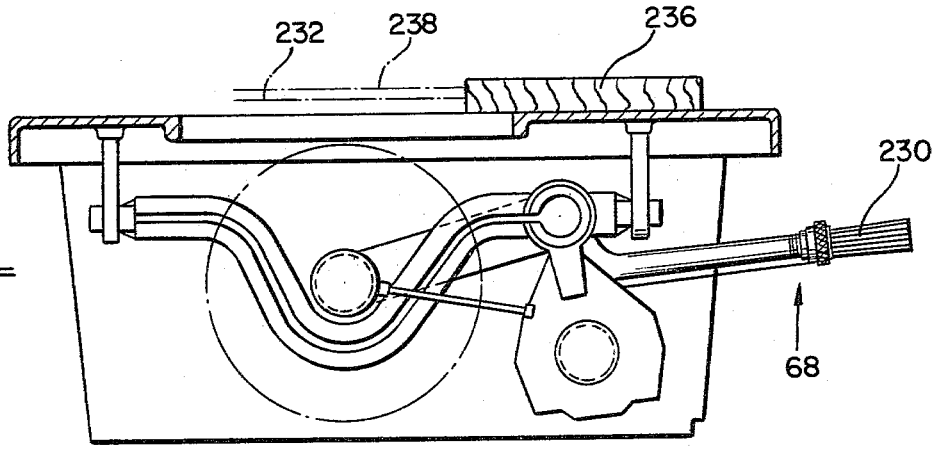
FIG. 9 is a schematic, side elevation view of the embodiment of the invention showing the tool assembly in its fully down position.
Figure 10:
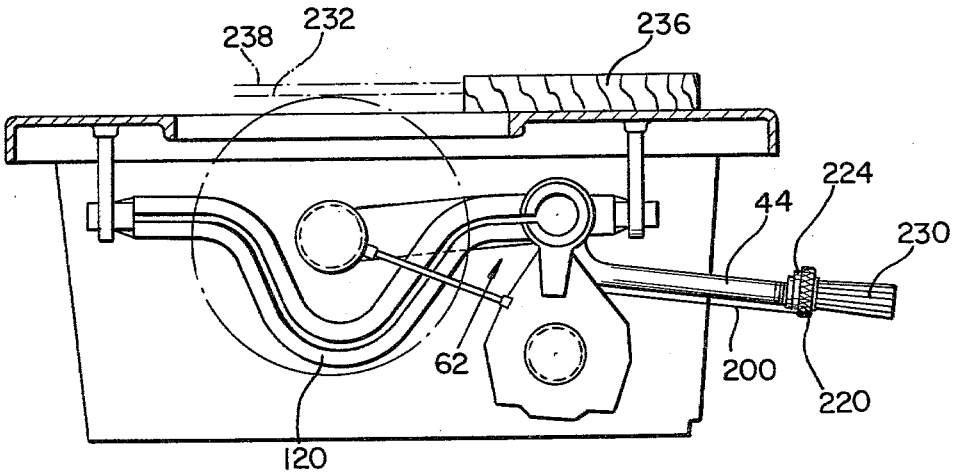
FIG. 10 is a schematic, side elevation view of the described embodiment of the invention showing the tool assembly in a coarse position relative to the workpiece.
Figure 11:
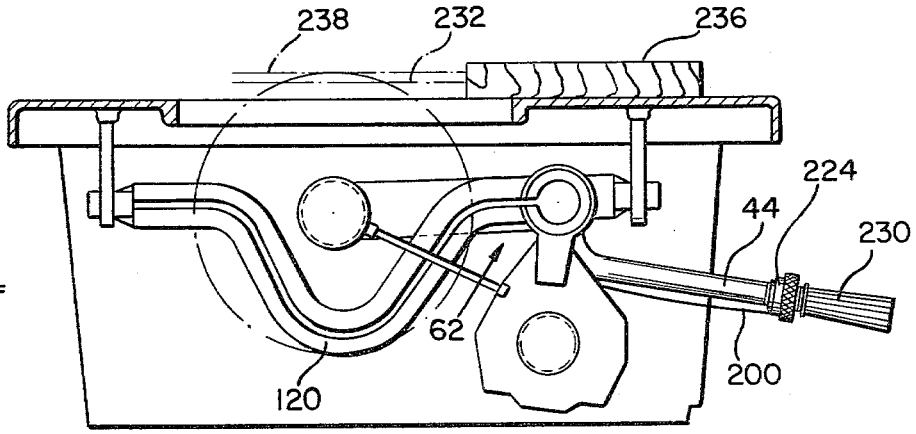
FIG. 11 is a schematic, side elevation view of the present embodiment of the invention showing the vernier adjustment of the tool elevation relative to the workpiece as effected by the vernier control means.

Interconnecting the two end sections 74 and 76 are intermediate, curved sections 120 and 122. FIGS. 9, 10 and 11 show that in profile, both sections 120 and 122 are generally, script v in shape. With respect to intermediate section 120, the v-shape facilitates the mounting of the tool to the arbor shaft.

Section 122 includes extending portions 124 and 126 which are disposed in the plane of section 74 and 76. They displace the curved portion 122 off line from the axis 128 of oppositely disposed legs of section 74 and 76. This is necessary to avoid interference problems with the mass of the elevating arm portion 130 of the first subassembly 62. The contour of section 122 cooperates with the tool hub 134 to restrain the downward movement of the subassembly 62 when the locking mechanism, otherwise holding that subassembly, is released.

Rotatably mounted in the hub 134 is the tool 42, which as illustrated is a saw blade. Of course, other rotating tools such as a dado head, molding cutter, grinding stone, etc., can be used. The rotational mount in hub 134 employs a standard arbor shaft mounting well known in this field. The arbor shaft includes at one end thereof, a pulley member 136.

Part of the first subassembly 62 is the tool drive means, including motor 64. Secured to its output shaft is pulley 140. Connecting pulleys 136 and 140 is belt 142, providing the necessary drive to the tool.

Tension rod 143 connects between the motor 64 and the tool hub 134. The mounting to the motor employs a unified movement type connection e.g. an "L" hook, disposed in a suitable opening in the motor housing. The rod is threaded at its connection to hub 134. Nut 144 bearing against hub 134 can be turned on this end to effect the required tension in belt 142.

Means 72, used for locking the assembly 58 at the desired bevel angle, includes the rotatable locking grip 50, and which further includes an appropriately shaped arm 145. Arm 145 is shaped so as to avoid interference problems throughout its travel path. The arm includes a flange section 146 which is mounted to the frame 60 at the same point where the pneumatic device 108 is secured.

Referring now to FIG. 4 there is illustrated the mounting means 70 for pivotally supporting assembly means 58 in the housing. Two mounting means 70 are required. The mount includes tabs 148 and 150 having thru holes for securing the mount to the underside of the table top 26. The mount is seen to include an arcuate track 152 in which is disposed the respective guide pin pairs, 82 and 84 or 94 and 96.

At the ends 154 and 156, of the arcuate track, there are threaded holes, 158 and 160. The latter accept set screws (not shown) which are used to set the bevel angle limits and thus limit the travel of the frame. The radius 162 of the track is centered at a point 164 which is disposed in the plane of the top surface of the table top, along the pivot axis of the assembly. The location of the center of the track radius at this point results in a cut being taken along the same guide mark on the workpiece, regardless of the bevel angle of the assembly 58. There is thus no need to adjust the cutting line on the workpiece to accommodate various bevel angles.

Figures 5, 6, 7, 8:
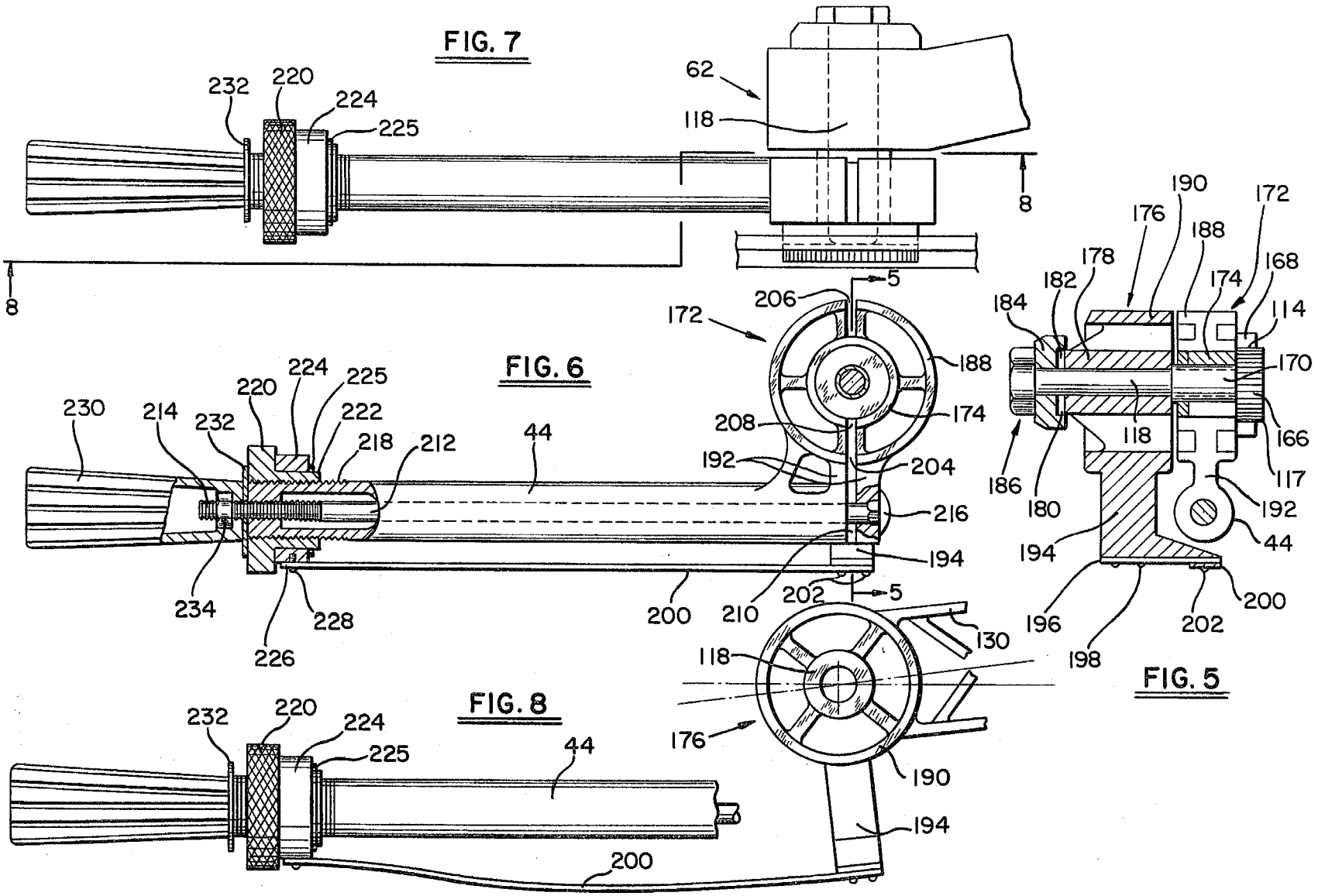
FIG. 5 is a sectional view taken along lines 5—5 of FIG. 6.
FIG. 6 is a side elevation view partially in section of the control means portion of the invention.
FIG. 7 is a plan view of FIG. 6.
FIG. 8 is a side elevation view, taken along lines 8—8 in FIG. 7.

Refer now to FIG. 5. This shows in detail the interrelationship of the pivotal mount for the first and second subassemblies, 62 and 65. Pivot nut 117 is seen to include a serrated or knurled peripheral portion 166. This is press-fitted during assembly into a cooperating hole 114, in side wall 168 of section 76 of the frame.

The pivot nut further includes a concentric hub portion 170 which can be viewed as part of the above-mentioned pivot means. The hub portion includes a threaded hole for accepting the complementing portion of shaft 118.

Control lever 44 of the first control means 66 includes a hub portion 172 which includes a split concentric section 174 in contact with the hub 170. The particular construction for the hub 172 will be better appreciated from the description which follows with respect to FIGS. 6 and 7.

Also pivotally mounted on shaft 118 is the vernier hub or hub portion, 176, of subassembly 62. As depicted, it is shown to include an innermost concentric section 178 for mounting on the shaft 118. The section 178 is seen to include a protruding cylindrical end section 180 which is aligned in a clearance fit with cutout 182, in side wall 184 of frame section 76.

Shaft 118 is seen to be a threaded bolt 186. In assembly, the hubs 172 and 176 are aligned between the side walls 168 and 184, the bolt 186 inserted and threaded into the pivot nut 117. The bolt 186 is tightened until a predetermined pre-load condition is achieved.

Hubs 172 and 176 include outer concentric sections 188 and 190, respectively. Extending radially downward (as viewed in FIG. 5), is flange extension 192. The latter is connected between the aforementioned outer section 188 and control lever 44.

Extending radially downward from outer concentric section 190 of hub 176 (again, as viewed in FIG. 5) is flange 194. Connected to the latter is a plate member 196 which is secured to the flange by screws 198. One end of leaf spring 200 is connected to flange 194 by screws 202.

Referring now to FIG. 6, the outer concentric section 188 of hub 172, is seen to be split at diagonally opposite points, 204 and 206. Inner concentric section, 174, of the hub 172, is seen to be split at point 208, radially in line with the break, 204, in the outer concentric section 188.

Radially extending flanges 192 is seen to be split at point 210, in line with the splits 204 and 208. The result is a split yoke which can be compressed about and against the pivot nut hub 170 so as to secure or lock the yoke thereto.

Control lever 44 is seen as a hollow, cylindrical arm. Control or clamp rod 212 is inserted in the hollow lever 44 and includes a threaded end 214 and a head end 216. The latter is keyed, complementing an appropriate opening in flange 192. This prevents rotational movement of the rod 212 in the locking procedure to be described hereinafter.

Control lever 44 includes a threaded end portion 218. Disposed thereon at that point is a knurled knob 220 which threadingly engages end 218. Slideably disposed on collar 222 of knob 220 is a hub member 224. The hub member is captured on the collar by a split, spring washer 225 disposed in an appropriate annular groove in the collar. End 226 of leaf spring 200 is secured to the hub by screw 228. Hand grip 230 (46 above) includes a knurled surface for easy gripping. Interposed between the end of the handle and the corresponding end of knob 220 is a washer 232. The handle 230 engages the threaded end 214 of rod 212 through threaded insert 234.

FIG. 7 is a plan view of the assembly shown in FIG. 6. It shows the knurled knob 220 in a position axially displaced from that indicated in FIG. 6. Hub 224 consequently, is urged to the right as viewed in the figure and effects pivotal movement of subassembly 62 about shaft 118 as best appreciated in FIG. 8.

As viewed in FIG. 8, rotation of knob 220 so as to advance itself axially towards the shaft 118 results in corresponding axial movement of hub 224. The latter effect is converted to pivotal movement of hub 176 of subassembly 62 through the fixed connection of the spring thereto at flange 194. The end result is pivotal movement of the tool through its mounting to tool supporting arm 130.

It is seen from FIG. 8, that the leaf spring 200 bows when hub 224 is axially urged to the right (as viewed in the figure). This is the result of the relative rotational displacement between the end 226 of the spring 200 fixed to the hub 224 (and thus prohibited from rotational movement because of its location on control lever 44), and the end of the spring 200 secured to flange 194 which rotates about shaft 118 defining the second pivot axis.

FIG. 9 shows the present invention with a workpiece 236 in place on the table top surface. The figure shows the tool in the fully down position. With the locking mechanism as described above released, the weight of the tool and supporting hub assembly is such as to cause movement downward of the tool completely below the top surface of the table top. This protects the operator from injury when the unit is not being used.

Having positioned the workpiece on the table top, the operator, if it is desired to cut a notch into the workpiece, for example, grips handle 230 and pushes downward on lever arm 44. The downward movement is converted into pivotal movement of hub 176 (FIG. 5) through the operative connection between the control lever 44 and the hub, accomplished through leaf spring 200 and flange 194. Pivotal movement of hub 176 results in upward movement of tool supporting arm 130 (see FIG. 3).

FIG. 10 shows the control lever 44 displaced downward to a point such that the apex of the rotated tool is at the coarse elevation setting line indicated at 232. At this location, the operator, with the same hand used to push the lever 44 downward, rotates the hand grip 230, whereby through its threaded engagement of rod 212, compression of the split yoke hub 172 is effected. Split section 174 of the split yoke secures the control lever to the hub 170 of pivot nut 114, locking the control lever at that point. Because of the stiffness of leaf spring 200, the tool assembly 62 is held in the coarse setting position.

FIG. 11 depicts the further, vernier adjustment of the tool elevation as accomplished by the operative action of the knurled knob 220 as effected upon the tool subassembly through leaf spring 200. As explained above, with respect to FIG. 8, rotation of knob 220 urges hub member 224 axially along the lever 44. This results in additional rotation of the tool supporting subassembly 62 and provides the operator with a fine adjustment of the tool elevation setting. Having achieved the vernier elevation setting desired as shown by broken line 238 of FIG. 11, the operator is then able to remove his hand from the control lever and urge the workpiece 236 towards the tool to effect the desired working operation.

Because of the proximate disposition of the knurled knob 220 to the hand grip 230, the operator can effect all vertical settings of the tool with but one hand and that without removing same from the lever 44 or even changing position thereon.

When it is desired to readjust the elevation setting of the tool the operator would grip handle 230 and rotate it in a direction opposite to that required to lock the lever. Having released the split yoke section from its locking engagement with hub 170 of the pivot nut, the operator is again in a position to locate the tool where desired. Again, if at this point there is no need to use the apparatus, the weight of the tool assembly is such as to cause it to pivot below the table top surface about the shaft 118.

Figure 13:
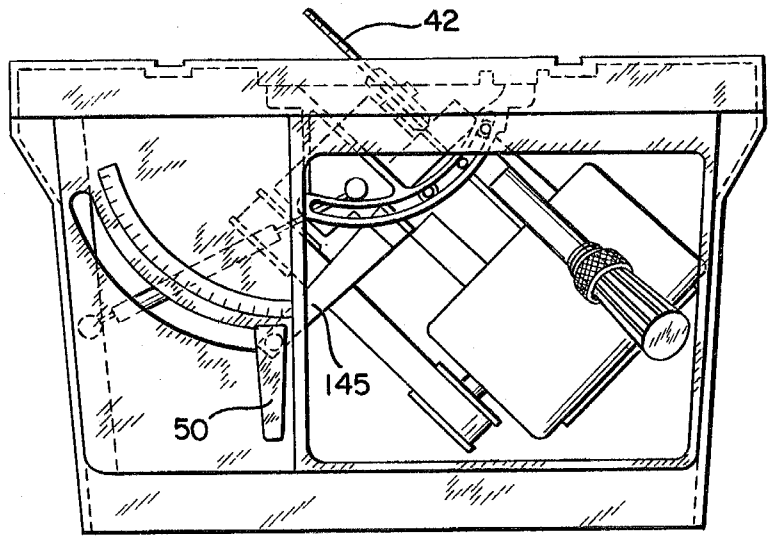
FIG. 13 is the same view as FIG. 12 but showing the bevel angle adjustment feature of the present invention.
Figure 12:
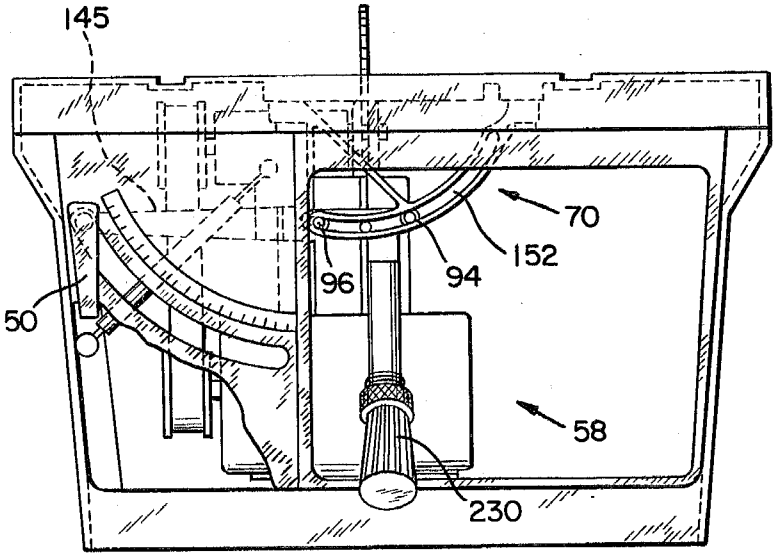
FIG. 12 is an end elevation view of the embodiment depicted in FIG. 1 with the end panel removed so as to reveal the assembly within.

Referring now to FIGS. 12 and 13, these depict in elevation view the front end of the present invention with the cover plate removed. It illustrates the bevel angle setting mechanism of the invention. As mentioned hereinabove with respect to FIG. 3, the assembly 58 via frame 60 is mounted within the housing by respective guide pin pairs 82 and 84, and 94 and 96. The pins are supported in the arcuate tracks, for example, 152, of the mounting means bracket 70 shown in FIG. 4.

When it is desired to set the assembly 58 at a particular bevel angle, rotatable locking grip 50 is turned so as to release it from contacting the cooperating front surface of the housing. This is simply a compression locking technique. The operator then grips handle 230 (and grip 50 if so needed) and exerts the required effort to effect pivotal movement about the first pivot axis referred to earlier and which extends through point 164 of FIG. 4. Having achieved the desired bevel angle, the operator would then rotate handle 50 to effect a locking of the assembly in the desired position and proceed with readjusting the elevation setting of the blade if necessary including the vernier setting referred to above. Here, the vernier setting of the tool would occur in the plane of the blade 42 for the angular bevel position thereof shown in FIG. 13.

FIG. 14 shows a portable version of the above described device. The housing 20 is seen to include handles 240 and 242 or 244 which are used to carry the unit to the work site. Placement on a table 246, saw horses, or the like, makes it readily available for any required use.

The numerous advantages of a design as described hereinabove will be apparent to those that work in the related arts. For example, a particularly difficult operation that carpenters often encounter is the cutting out of sections from a panel of whatever kind, sheet rock, finish panel, counter top, etc. With the present invention such cuts are greatly simplified. For example, where it would be necessary to cut a section out of a plywood sheet say, for example, a sink location, the operator places the uncut panel in position on the present device. He then grips the control lever, releases the locking mechanism if necessary, and pushes down on the lever in the area of the intended cut out. He plunges the blade through the panel and then locks the control lever in place. He would then push the panel in the desired direction and then unlock the control lever and allow the blade to drop out from engagement with the panel. Having turned the panel in a different direction, he would proceed with his cutting operation in the same fashion. The procedure would be repeated until the section was removed.

The present invention further facilitates "tough" cutting operations. The coarse setting feature allows the blade to be continually raised and lowered in an oscillating manner to accomplish some of the more difficult or prolonged cuts which might be experienced, for example, rip cutting. This eases the load on the tool and the drive means minimizing adverse consequences.

Still another advantage of the plunge cutting feature of this invention is the facility it provides in handling relatively wide workpieces. For example, in order to make a cut in such a workpiece with the invention the item is placed on the table top, the blade brought up to and then into the workpiece until it is penetrated completely. The workpiece is then pushed off the table until the cut is finished to the one edge. The locking mechanism is then released, the blade dropped below the table top and the piece of wood rotated 180°. The blade is again brought up into the kerf of the previous cut, locked in place and the cut completed to the opposite edge.

The fact that the work surface is horizontal and remains so for any bevel cut, allows its use on longer work pieces, such as joists. This feature is important to the home builder.

The major parts comprising the apparatus e.g. the frame, tool supporting subassembly, housing, etc., can be die cast aluminum. The table top can be manufactured from aluminum, and machined to achieve a suitable work surface or molded from plastic. The simplified design thus lends itself to mass production, but not at the sacrifice of accuracy.

The portability of the unit allows the carpenter to bring his unit to any place in the house. He can set it on the floor or on appropriately sized horses and with a rafter guage, cut his joists or whatever, in an easy fashion.

Of course, other variations and adaptations to the above can be developed which are within the scope of the present invention. For example, as noted earlier, it is to be understood that the present invention has much broader application than just a table saw. Groove cutting, molding, shaping and the like are readily accomplished by this tool particularly in view of the vernier adjust feature.

Further, the sophisticated frame-mount support for the pivoted assembly can be replaced by a simple rod pivoting connection wherein the rod is mounted to the underside of the table top and the assembly pivoted thereabout. This further reduces the weight, size and cost of the unit, enhancing its portability and availability.

What is claimed is:

1. A table saw comprising:

a housing including a tabletop having an opening through which a motor-driven saw blade can pass;

assembly means pivotally mounted in said housing about a first pivot axis, said assembly means including, pivot means defining a second pivot axis and fixedly connected to said assembly means, subassembly means pivotally mounted on said pivot means and including the saw blade, first control means including, a control level operatively connected to said subassembly means for pivoting same about said second pivot axis, whereby the saw blade is raised or lowered in said opening to a first elevation with respect to the tabletop in a relatively quick setting manner, and locking means for securing said control lever at a position corresponding to said first elevation setting for the saw blade, the control lever operatively connected to the assembly means to pivot the assembly means about said first pivot axis, whereby the angle of the saw blade relative to said tabletop is varied, said locking means proximately disposed to said control level such that both are manipulatable by the same hand of the operator, without removing the hand from said lever throughout the complete elevation setting operation, second control means operatively connected to said subassembly means for pivoting said subassembly means about said second pivot axis independently of said control lever, said second control means providing a further elevation adjustment of the saw blade, and means for locking said assembly means to said housing at the desired angle of the saw blade relative to the tabletop.

2. A table saw comprising:

a housing including a tabletop having an opening through which a motor-driven saw blade can pass;

assembly means pivotally mounted in said housing about a first pivot axis, said assembly means including, pivot means defining a second pivot axis and fixedly connected to said assembly means, subassembly means pivotally mounted on said pivot means and including the saw blade, control means including, a control level operatively connected to said subassembly means for pivoting same about said second pivot axis, whereby the saw blade is raised or lowered in said opening to a desired elevation with respect to the tabletop in a relatively quick setting manner, and locking means for securing said control level at a position corresponding to said desired elevation setting for the saw blade, the control level operatively connected to the assembly means to pivot the assembly means about said first pivot axis, whereby the angle of the saw blade relative to said tabletop is varied, said locking means proximately disposed to said control lever such that both are manipulatable by the same hand of the operator, without removing the hand from said lever throughout the complete elevation setting operation, and means for locking said assembly means to said housing at the desired angle of the saw blade relative to the table top.

3. A power tool apparatus comprising:

a housing including a tabletop having an opening through which a motor-driven tool can pass;

assembly means pivotally mounted in said housing about a first pivot axis, said assembly means including, pivot means defining a second pivot axis and fixedly connected to said assembly means, subassembly means pivotally mounted on said pivot means and including the tool, first control means including, a control lever operatively connected to said subassembly means for pivoting same about said second pivot axis, whereby the tool is raised or lowered in said opening to a first elevation with respect to the tabletop in a relatively quick setting manner, and locking means for securing said control lever at a position corresponding to said first elevation setting for the tool, said locking means proximately disposed to said control lever such that both are manipulatable by the same hand of the operator, without removing the hand from said lever throughout the complete elevation setting operation, and, second control means operatively connected to said subassembly means for pivoting said subassembly means about said second pivot axis independently of said control lever to provide a further elevation adjustment of the tool, said second control means proximately disposed to said control lever such that said second control means is manipulatable by the same hand of the operator without removing the hand from said lever throughout the complete elevation setting operation; and, means for pivoting said assembly means about said first pivot axis, whereby the angle of the tool relative to said table top is varied.

4. A power tool apparatus comprising:

a housing including a tabletop having an opening through which a motor-driven tool can pass;

assembly means pivotally mounted in said housing about a first pivot axis, said assembly means including, pivot means defining a second pivot axis and fixedly connected to said assembly means, subassembly means pivotally mounted on said pivot means and including the tool, first control means including, a control lever operatively connected to said subassembly means for pivoting same about said second pivot axis, whereby the tool is raised or lowered in said opening to a first elevation with respect to the tabletop in a relatively quick setting manner, and locking means for securing said control lever at a position corresponding to said first elevation setting for the tool, said locking means including a split yoke disposed about said pivot means, a control rod, and a rotatable hand grip disposed upon said control lever, said control rod operatively connected between said split yoke and said rotatable hand grip such that said split yoke is secured to said pivot means when said grip is rotated in one direction and wherein said yoke is released from a secured connection to said pivot means when said grip is rotated in the opposite direction, and, second control means operatively connected to said subassembly means for pivoting said subassembly means about said second pivot axis independently of said control lever to provide a further elevation adjustment of the tool, said second control means proximately disposed to said control lever such that said second control means is manipulatable by the same hand of the operator without removing the hand from said lever throughout the complete elevation setting operation; and, means for pivoting said assembly means about said first pivot axis, whereby the angle of the tool relative to said table top is varied.

5. A power tool apparatus comprising:

a housing including a tabletop having an opening through which a motor-driven tool can pass;

assembly means pivotally mounted in said housing about a first pivot axis, said assembly means including, pivot means defining a second pivot axis and fixedly connected to said assembly means, subassembly means pivotally mounted on said pivot means and including the tool, first control means including, a control lever operatively connected to said subassembly means for pivoting same about said second pivot axis, whereby the tool is raised or lowered in said opening to a first elevation with respect to the tabletop in a relatively quick setting manner, and locking means for securing said control lever at a position corresponding to said first elevation setting for the tool, said locking means proximately disposed to said control lever such that both are manipulatable by the same hand of the operator, without removing the hand from said lever throughout the complete elevation setting operation, and, second control means operatively connected to said subassembly means for pivoting said subassembly means about said second pivot axis independently of said control lever thereby providing a further elevation adjustment of the tool, said second control means including a leaf spring disposed along the length of said control lever, hub means disposed at one end of said control lever and fixedly connected to one end of said leaf spring, the remaining end of said leaf spring fixedly connected to said subassembly means, and means for urging said hub means axially along said control lever arm, whereby the stress developed in said leaf spring is transmitted through its operative connection to said subassembly means to cause pivoting thereof about said second pivot axis, said means for urging said hub means proximately disposed on said control lever so as to be manipulatable by the same hand of the operator without removing the hand from said lever throughout the complete elevation setting operation; and, means for pivoting said assembly means about said first pivot axis, whereby the angle of the tool relative to said table top is varied.

6. A power tool apparatus comprising:

a housing including a tabletop having an opening through which a motor-driven tool can pass;

assembly means pivotally mounted in said housing about a first pivot axis, said assembly means including, pivot means defining a second pivot axis and fixedly connected to said assembly means, subassembly means pivotally mounted on said pivot means and including the tool, first control means including, a control lever operatively connected to said subassembly means for pivoting same about said second pivot axis whereby the tool is raised or lowered in said opening to a first elevation with respect to the tabletop in a relatively quick setting manner, and locking means for securing said control lever at a position corresponding to said first elevation setting for the tool, said locking means including a split yoke disposed about said pivot means, a control rod, and a rotatable hand grip disposed upon said control lever, said control rod operatively connected between said split yoke and said rotatable hand grip such that said split yoke is secured to said pivot means when said grip is rotated in one direction and wherein said yoke is released from a secured connection to said pivot means when said grip is rotated in the opposite direction, and, second control means operatively connected to said subassembly means for pivoting said subassembly means about said second pivot axis independently of said control lever thereby providing a further elevation adjustment of the tool, said second control means including a leaf spring disposed along the length of said control lever, hub means disposed at one end of said control lever and fixedly connected to one end of said leaf spring, the remaining end of said leaf spring fixedly connected to said subassembly means and means for uring said hub means axially along said control lever arm, whereby the stress developed in said leaf spring is transmitted through its operative connection to said subassembly means to cause pivoting thereof about said second pivot axis;

said means for urging said hub means proximately disposed on said control lever so as to be manipulatable by the same hand of the operator without removing the hand from said lever throughout the complete elevation setting operation; and, means for pivoting said assembly means about said first axis, whereby the angle of the tool relative to said table top is varied.

7. A power tool apparatus comprising:

a housing including a tabletop having an opening through which a motor-driven tool can pass;

assembly means pivotally mounted in said housing about a first pivot axis, said assembly means including, pivot means defining a second pivot axis and fixedly connected to said assembly means;

a first subassembly pivotally mounted on said pivot means and including the tool;

a second subassembly also pivotally mounted on said pivot means and including a first control means having a control lever for pivoting said second subassembly about said second pivot axis;

means connecting said first subassembly to said second subassembly whereby said first subassembly and said second subassembly pivot in unison about said second pivot axis, whereby the tool is raised or lowered in said opening to a first elevation with respect to the tabletop in a relatively quick setting manner, said second subassembly further including locking means for securing said second subassembly at a position corresponding to said first elevation setting for the tool, said locking means proximately disposed to said control lever such that both are manipulatable by the same hand of the operator, without removing th hand from said lever throughout the complete elevation setting operation; and, second control means operatively connected to said first subassembly for pivoting said first subassembly about said second pivot axis to effect a further elevation adjustment of the tool, said second control means proximately disposed to said control lever such that said second control means is manipulatable by the same hand of the operator without removing the hand from said lever throughout the complete elevation setting operation; and, means for pivoting said assembly means about said first axis, whereby the angle of the tool relative to said table top is varied.

8. A power tool apparatus comprising:

a housing including a tabletop having an opening through which a motor-driven tool can pass;

assembly means pivotally mounted in said housing about a first pivot axis, said assembly means including, frame means, pivot means defining a second pivot axis and fixedly connected to said frame means;

a first subassembly pivotally mounted on said pivot means and including the tool;

a second subassembly also pivotally mounted on said pivot means and including a first control means having a control lever for pivoting said second subassembly about said second pivot axis;

means connecting said first subassembly to said second subassembly whereby said first subassembly and said second subassembly pivot in unison about said second pivot axis whereby the tool is raised or lowered in said opening to a first elevation with respect to the tabletop in a relatively quick setting manner, said second subassembly further including locking means for securing said second subassembly at a position corresponding to said first elevation setting for the tool, said locking means including a split yoke disposed about said pivot means, a control rod, and a rotatable hand grip disposed upon said control lever, said control rod operatively connected between said split yoke and said rotatable hand grip such that said split yoke is secured to said pivot means when said grip is rotated in one direction and wherein said yoke is released from a secured connection to said pivot means when said grip is rotated in the opposite direction, and, second control means operatively connected to said first subassembly for pivoting said first subassembly about said second pivot axis to effect a further adjustment of the tool, said second control means including a leaf spring disposed along the length of said control lever, hub means disposed at one end of said control lever and fixedly connected to one end of said leaf spring, the remaining end of said leaf spring fixedly connected to said first subassembly, and means for urging said hub means axially along said control lever arm, whereby the stress developed in said leaf spring is transmitted through its operative connection to said first subassembly to cause pivoting thereof about said second pivot axis, said means for urging said hub means proximately disposed on said control lever so as to be manipulatable by the same hand of the operator without removing the hand from said lever throughout the complete elevation setting operation; and, means for pivoting said assembly means about said axis, whereby the angle of the tool relative to said table top is varied.

9. A power tool apparatus comprising:

a table defining a stationary horizontal work surface for supporting a workpiece and having a slot formed therein;

an assembly mounted beneath said table;

motor-driven tool means including a tool pivotally mounted on said assembly;

said assembly being pivotally mounted beneath said table so as to be movable between a first angular position whereat said tool is movable in a first plane perpendicular to said work surface and a second angular position whereat said tool is movable in a second plane defining an acute angle with said work surface;

lever control means for selectively raising and lowering the tool in said slot to effect a "coarse" adjustment of the tool relative to said work surface in one of said planes depending upon the angular position of said assembly; and, vernier means included in said lever control means for effecting a fine adjustment of said tool relative to said stationary horizontal work surface of said table in said one plane.

10. A power tool apparatus comprising:

a housing including a tabletop having a slot formed therein;

a motor-driven tool extending through the slot;

movable assembly means for the motor-driven tool, mounted in said housing beneath said table top;

first control means for selectively locking and unlocking said movable assembly means with respect to said table top, said first control means being adapted to be selectively raised and lowered in its unlocked position, thereby selectively raising and lowering the tool to effect a "coarse" adjustment thereof relative to the table top;

vernier means included in said first control means to effect a "fine" adjustment of the tool relative to the table top thereby providing a one-hand control of the tool elevation; and, a second control means operatively connected to said movable assembly means to effect a tilting of the rotary axis of the motor-driven tool within certain angular limits and in any selected elevation of the tool, thereby accommodating bevel cuts.

11. A portable power tool apparatus comprising:

a compact housing including a work surface having an opening for accommodating a motor-driven tool, and further including handle means for easily carrying the apparatus;

assembly means including the tool, pivotally mounted in the housing beneath the work surface;

first control means including lever means, for selectively, raising and lowering the tool in the opening relative to the work surface to effect a "coarse" adjustment of the tool, and further including means for selectively locking and unlocking the lever means at the coarse elevation, said first control means further including vernier control means to effect a "fine" adjustment of the tool relative to the work surface, whereby one-hand control of the tool elevation is effected; and, second control means operatively connected to said assembly means to effect a tilting of the rotary axis of the tool within certain angular limits and in any selected elevation of the tool.

12. The apparatus claimed in any one of claims 3, 5 or 7 wherein said locking means includes:

a split yoke disposed about said pivot means;

a control rod; and a rotatable hand grip disposed upon said control lever, said control rod operatively connected between said split yoke and said rotatable hand grip such that said split yoke is secured to said pivot means when said grip is rotated in one direction and wherein said yoke is released from a secured connection to said pivot means when said grip is rotated in the opposite direction.

13. The apparatus claimed in any one of claims 3, 4 or 7 wherein said second control means comprises:

a leaf spring disposed along the length of said control lever;

hub means disposed at one end of said control lever and fixedly connected to one end of said leaf spring, the remaining end of said leaf spring fixedly connected to said respective subassembly and means for urging said hub means axially along said control lever arm, whereby the stress developed in said leaf spring is transmitted through its operative connection to said respective subassembly to cause pivoting thereof about said second pivot axis.

14. The apparatus claimed in any one of claims 3 through 8 inclusive, wherein said means for pivoting said assembly means consists of said control lever.

15. The apparatus claimed in claim 14 further comprising means for locking said assembly means to said housing at the desired angle of the tool relative to the table top.

16. The apparatus claimed in any one of claims 3 through 8 inclusive, wherein said control lever effects a coarse setting of the tool relative to the table top and wherein said second control means effects a vernier setting of the tool.

17. A table saw comprising:

a housing including a tabletop having an opening through which a motor-driven saw blade can pass;

assembly means pivotally mounted in said housing about a first pivot axis, said assembly means including, pivot means defining a second pivot axis and fixedly connected to said assembly means, subassembly means pivotally mounted on said pivot means and including the saw blade, first control means including, a control lever operatively connected to said subassembly means for pivoting same about said second pivot axis, whereby the saw blade is raised or lowered in said opening to a first elevation with respect to the tabletop in a relatively quick setting manner, and locking means for securing said control lever at a position corresponding to said first elevation setting for the saw blade, the control lever operatively connected to the assembly means to pivot the assembly means about said first pivot axis, whereby the angle of the saw blade relative to said tabletop is varied, said locking means proximately disposed to said control lever such that both are manipulatable by the same hand of the operator, without removing the hand from said lever throughout the complete elevation setting operation, second control means operatively connected to said subassembly means for pivoting said subassembly means about said second pivot axis independently of said control lever, and said second control means providing a further elevation adjustment of the saw blade.

18. A table saw comprising:

a housing including a tabletop having an opening through which a motor-driven saw blade can pass;

assembly means pivotally mounted in said housing about a first pivot axis, said assembly means including, pivot means defining a second pivot axis and fixedly connected to said assembly means, subassembly means pivotally mounted on said pivot means and including the saw blade, control means including, a control lever operatively connected to said subassembly means for pivoting same about said second pivot axis, whereby the saw blade is raised or lowered in said opening to a desired elevation with respect to the tabletop in a relatively quick setting manner, and locking means for securing said control lever at a position corresponding to said desired elevation setting for the saw blade, the control lever operatively connected to the assembly means to pivot the assembly means about said first pivot axis, whereby the angle of the saw blade relative to said tabletop is varied, and said locking means proximately disposed to said control lever such that both are manipulatable by the same hand of the operator, without removing the hand from said lever throughout the complete elevation setting operation.

19. A table saw comprising:

a housing including a tabletop having an opening through which a motor-driven saw blade can pass;

assembly means pivotally mounted in said housing about a first pivot axis, said assembly means including, pivot means defining a second pivot axis and fixedly connected to said assembly means, subassembly means pivotally mounted on said pivot means and including the saw blade, first control means including, a control lever operatively connected to said subassembly means for pivoting same about said second pivot axis, whereby the saw blade is raised or lowered in said opening to a first elevation with respect to the tabletop in a relatively quick setting manner, and locking means for securing said control lever at a position corresponding to said first elevation setting for the saw blade, said locking means proximately disposed to said control lever such that both are manipulatable by the same hand of the operator, without removing the hand from said lever throughout the complete elevation setting operation, and, second control means operatively connected to said subassembly means for pivoting said subassembly means about said second pivot axis independently of said control lever to provide a further elevation adjustment of the saw blade, said second control means proximately disposed to said control lever such that said second control means is manipulatable by the same hand of the operator without removing the hand from said lever throughout the complete elevation setting operation; and, means for pivoting said assembly means about said first pivot axis, whereby the angle of the saw blade relative to said table top is varied.

20. A table saw comprising:

a housing including a tabletop having an opening through which a motor-driven saw blade can pass;

assembly means pivotally mounted in said housing about a first pivot axis, said assembly means including, pivot means defining a second pivot axis and fixedly connected to said assembly means, subassembly means pivotally mounted on said pivot means and including the saw blade, first control means including, a control lever operatively connected to said subassembly means for pivoting same about said second pivot axis, whereby the saw blade is raised or lowered in said opening to a first elevation with respect to the tabletop in a relatively quick setting manner, and locking means for securing said control lever at a position corresponding to said first elevation setting for the saw blade, said locking means including a split yoke disposed about said pivot means, a control rod, and a rotatable hand grip disposed upon said control lever, said control rod operatively connected between said split yoke and said rotatable hand grip such that said split yoke is secured to said pivot means when said grip is rotated in one direction and wherein said yoke is released from a secured connection to said pivot means when said grip is rotated in the opposite direction, and, second control means operatively connected to said subassembly means for pivoting said subassembly means about said second pivot axis independently of said control lever to provide a further elevation adjustment of the table saw, said second control means proximately disposed to said control lever such that said second control means is manipulatable by the same hand of the operator without removing the hand from said lever throughout the complete elevation setting operation; and, means for pivoting said assembly means about said first pivot axis, whereby the angle of the table saw relative to said table top is varied.

21. A table saw comprising:

a housing including a tabletop having an opening through which a motor-driven saw blade can pass;

assembly means pivotally mounted in said housing about a first pivot axis, said assembly means including, pivot means defining a second pivot axis and fixedly connected to said assembly means, subassembly means pivotally mounted on said pivot means and including the saw blade, first control means including, a control lever operatively connected to said subassembly means for pivoting same about said second pivot axis, whereby the saw blade is raised or lowered in said opening to a first elevation with respect to the tabletop in a relatively quick setting manner, and locking means for securing said control lever at a position corresponding to said first elevation setting for the saw blade, said locking means proximately disposed to said control lever such that both are manipulatable by the same hand of the operator, without removing the hand from said lever throughout the complete elevation setting operation, and, second control means operatively connected to said subassembly means for pivoting said subassembly means about said second pivot axis independently of said control lever thereby providing a further elevation adjustment of the saw blade, said second control means including a leaf spring disposed along the length of said control lever, hub means disposed at one end of said control lever and fixedly connected to one end of said leaf spring, the remaining end of said leaf spring fixedly connected to said subassembly means, and means for urging said hub means axially along said control lever arm, whereby the stress developed in said leaf spring is transmitted through its operative connection to said subassembly means to cause pivoting thereof about said second pivot axis, said means for urging said hub means proximately disposed on said control lever so as to be manipulatable by the same hand of the operator without removing the hand from said lever throughout the complete elevation setting operation; and, means for pivoting said assembly means about said first pivot axis, whereby the angle of the saw blade relative to said table top is varied.

22. A table saw comprising:

a housing including a tabletop having an opening through which a motor-driven saw blade can pass;

assembly means pivotally mounted in said housing about a first pivot axis, said assembly means including, pivot means defining a second pivot axis and fixedly connected to said assembly means, subassembly means pivotally mounted on said pivot means and including the saw blade, first control means including, a control lever operatively connected to said subassembly means for pivoting same about said second pivot axis whereby the saw blade is raised or lowered in said opening to a first elevation with respect to the tabletop in a relatively quick setting manner, and locking means for securing said control lever at a position corresponding to said first elevation setting for the saw blade, said locking means including a split yoke disposed about said pivot means, a control rod, and a rotatable hand grip disposed upon said control lever, said control rod operatively connected between said split yoke and said rotatable hand grip such that said split yoke is secured to said pivot means when said grip is rotated in one direction and wherein said yoke is released from a secured connection to said pivot means when said grip is rotated in the opposite direction, and, second control means operatively connected to said subassembly means for pivoting said subassembly means about said second pivot axis independently of said control lever thereby providing a further elevation adjustment of the saw blade, said second control means including a leaf spring disposed along the length of said control lever, hub means disposed at one end of said control lever and fixedly connected to one end of said leaf spring, the remaining end of said leaf spring fixedly connected to said subassembly means and means for urging said hub means axially along said control lever arm, whereby the stress developed in said leaf spring is transmitted through its operative connection to said subassembly means to cause pivoting thereof about said second pivot axis;

said means for urging said hub means proximately disposed on said control lever so as to be manipulatable by the same hand of the operator without removing the hand from said lever throughout the complete elevation setting operation; and, means for pivoting said assembly means about said first pivot axis, whereby the angle of the saw blade relative to said table top is varied.

23. A table saw comprising:

a housing including a tabletop having an opening through which a motor-driven saw blade can pass;

assembly means pivotally mounted in said housing about a first pivot axis, said assembly means including, pivot means defining a second pivot axis and fixedly connected to said assembly means;

a first subassembly pivotally mounted on said pivot means and including the saw blade, a second subassembly also pivotally mounted on said pivot means and including a first control means having a control lever for pivoting said second subassembly about said second pivot axis;

means connecting said first subassembly to said second subassembly whereby said first subassembly and said second subassembly pivot in unison about said second pivot axis, whereby the saw blade is raised or lowered in said opening to a first elevation with respect to the tabletop in a relatively quick setting manner, said second subassembly further including locking means for securing said second subassembly at a position corresponding to said first elevation setting for the saw blade, said locking means proximately disposed to said control lever such that both are manipulatable by the same hand of the operator, without removing the hand from said lever throughout the complete elevation setting operation; and, second control means operatively connected to said first subassembly for pivoting said first subassembly about said second pivot axis to effect a further elevation adjustment of the saw blade, said second control means proximately disposed to said control lever such that said second control means is manipulatable by the same hand of the operator without removing the hand from said lever throughout the complete elevation setting operation; and, means for pivoting said assembly means about said first pivot axis, whereby the angle of the saw blade relative to said table top is varied.

24. A table saw comprising:

a housing including a tabletop having an opening through which a motor-driven saw blade can pass;

assembly means pivotally mounted in said housing about a first pivot axis, said assembly means including, frame means, pivot means defining a second pivot axis and fixedly connected to said frame means;

a first subassembly pivotally mounted on said pivot means and including the saw blade, a second subassembly also pivotally mounted on said pivot means and including a first control means having a control lever for pivoting said second subassembly about said second pivot axis;

means connecting said first subassembly to said second subassembly whereby said first subassembly and said second subassembly pivot in unison about said second pivot axis whereby the saw blade is raised or lowered in said opening to a first elevation with respect to the tabletop in a relatively quick setting manner, said second subassembly further including locking means for securing said second subassembly at a position corresponding to said first elevation setting for the saw blade, said locking means including a split yoke disposed about said pivot means, a control rod, and a rotatable hand grip disposed upon said control lever, said control rod operatively connected between said split yoke and said rotatable hand grip such that said split yoke is secured to said pivot means when said grip is rotated in one direction and wherein said yoke is released from a secured connection to said pivot means when said grip is rotated in the opposite direction, and, second control means operatively connected to said first subassembly for pivoting said first subassembly about said second pivot axis to effect a further elevation adjustment of the saw blade, said second control means including a leaf spring disposed along the length of said control lever, hub means disposed at one end of said control lever and fixedly connected to one end of said leaf spring, the remaining end of said leaf spring fixedly connected to said first subassembly, and means for urging said hub means axially along said control lever arm, whereby the stress developed in said leaf spring is transmitted through its operative connection to said first subassembly to cause pivoting thereof about said second pivot axis, said means for urging said hub means proximately disposed on said control lever so as to be manipulatable by the same hand of the operator without removing the hand from said lever throughout the complete elevation setting operation; and, means for pivoting said assembly means about said first pivot axis, whereby the angle of the saw blade relative to said table top is varied.

25. A table saw comprising:

a table defining a stationary horizontal work surface for supporting a workpiece and having a slot formed therein;

an assembly mounted beneath said table;

motor-driven saw means including a saw blade pivotally mounted on said assembly;

said assembly being pivotally mounted beneath said table so as to be movable between a first angular position whereat said saw blade is movable in a first plane perpendicular to said work surface and a second angular position whereat said saw blade is movable in a second plane defining an acute angle with said work surface;

lever control means for selectively raising and lowering the saw blade in said slot to effect a "coarse" adjustment of the saw blade relative to said work surface in one of said planes depending upon the angular position of said assembly; and, vernier means included in said lever control means for effecting a fine adjustment of said saw blade relative to said stationary horizontal work surface of said table in said one plane.

26. A table saw comprising:

a housing including a tabletop having a slot formed therein;

a motor driven saw blade extending through the slot;

movable assembly means for the motor-driven saw blade mounted in said housing beneath said table top;

a first control means for selectively locking and unlocking said movable assembly means with respect to said table top, said first control means being adapted to be selectively raised and lowered in its unlocked position, thereby selectively raising and lowering the saw blade to effect a "coarse" adjustment thereof relative to the table top;

vernier means included in said first control means to effect a "fine" adjustment of the saw blade relative to the table top, thereby providing a one-hand control of the saw blade elevation; and, a second control means operatively connected to said movable assembly means to effect a tilting of the rotary axis of the motor-driven saw blade within certain angular limits and in any selected elevation of the saw blade thereby accommodating bevel cuts.

27. A portable power saw comprising:

a compact housing including a work surface having an opening for accommodating a motor-driven saw blade and further including handle means for easily carrying the apparatus;

assembly means including the saw blade, pivotally mounted in the housing beneath the work surface;

first control means including lever means, for selectively, raising and lowering the saw blade, in the opening relative to the work surface to effect a "coarse" adjustment of the saw blade, and further including means for selectively locking and unlocking the lever means at the coarse elevation, said first control means further including vernier control means to effect a "fine" adjustment of the saw blade relative to the work surface, whereby one-hand control of the saw blade elevation is effected; and, second control means operatively connected to said assembly means to effect a tilting of the rotary axis of the saw blade within certain angular limits and in any selected elevation of the saw blade.

28. The table saw claimed in any one of claims 19, 21 or 23 wherein said locking means includes:

a split yoke disposed about said pivot means;

a control rod; and a rotatable hand grip disposed upon said control lever, said control rod operatively connected between said split yoke and said rotatable hand grip such that said split yoke is secured to said pivot means when said grip is rotated in one direction and wherein said yoke is released from a secured connection to said pivot means when said grip is rotated in the opposite direction.

29. The table saw claimed in any one of claims 19, 20 or 23 wherein said second control means comprises:

a leaf spring disposed along the length of said control lever;

hub means disposed at one end of said control lever and fixedly connected to one end of said leaf spring, the remaining end of said leaf spring fixedly connected to said respective subassembly, and, means for urging said hub means axially along said control lever arm, whereby the stress developed in said leaf spring is transmitted through its operative connection to said respective subassembly to cause pivoting thereof about said second pivot axis.

30. The table saw claimed in any one of claims 19 through 24 inclusive, wherein said means for pivoting said assembly means consists of said control lever.

31. The table saw claimed in claim 30 further comprising means for locking said assembly means to said housing at the desired angle of the saw blade relative to the table top.

32. The table saw claimed in any one of claims 19 through 24 inclusive, wherein said control lever effects a coarse setting of the saw blade relative to the table top and wherein said second control means effects a vernier setting of the saw blade.

33. A method of making bevel cuts with the saw blade of a table saw including: a table for supporting a workpiece and having a slot formed therein; a support chassis mounted beneath the table, motor driven saw means including a saw blade pivotally mounted on the support chassis, the support chassis being pivotably mounted beneath the table so as to be movable between a first angular position whereat the saw blade is movable in a first cutting plane perpendicular to the table and a second angular position whereat the saw blade is movable in a second cutting plane defining an acute angle with the table; lever control means for selectively raising and lowering the saw blade in the slot to effect a "coarse" adjustment of the saw blade relative to the table top in one of said cutting planes depending upon the angular position of the support chassis; and, vernier means mounted on said lever control means for effecting a fine adjustment of the saw blade relative to the table in said one plane, the method comprising the steps of:

manually actuating said lever control means to raise said saw blade to a selected coarse adjusted position relative to the table top;

pivotally moving said support chassis from a first angular position to the second angular position thereby placing said saw blade in said second cutting plane; and, manually adjusting said vernier means to effect a fine adjustment of said saw blade relative to said table.

34. A table saw comprising:

a housing including a tabletop having an opening through which a motor-driven saw blade can pass;

assembly means pivotally mounted in said housing about a first pivot axis, said assembly means including, pivot means defining a second pivot axis and fixedly connected to said assembly means, subassembly means pivotally mounted on said pivot means and including the saw blade, first control means including, a control lever operatively connected to said subassembly means for pivoting same about said second pivot axis, whereby the saw blade is raised or lowered in said opening to a first elevation with respect to the tabletop in a relatively quick setting manner, and locking means for securing said control lever at a position corresponding to said first elevation setting for the saw blade, said locking means proximately disposed to said control lever such that both are manipulatable by the same hand of the operator, without removing the hand from said lever throughout the complete elevation setting operation, second control means operatively connected to said subassembly means for pivoting said subassembly means about said second pivot axis independently of said control lever and providing a further elevation adjustment of the saw blade, the second control means having, a leaf spring disposed along the length of said control lever;

hub means disposed at one end of said control lever and fixedly connected to one end of said leaf spring, the remaining end of said leaf spring fixedly connected to said respective subassembly, and means for urging said hub means axially along said control lever arm, whereby the stress developed in said leaf spring is transmitted through its operative connection to said respective subassembly to cause pivoting thereof about said second pivot axis, means for pivoting said assembly means about said first pivot axis, whereby the angle of the saw blade relative to said tabletop is varied.

35. A table saw comprising:

a housing including a tabletop having an opening through which a motor-driven saw blade can pass;

assembly means pivotally mounted in said housing about a first pivot axis, said assembly means including, pivot means defining a second pivot axis and fixedly connected to said assembly means, subassembly means pivotally mounted on said pivot means and including the saw blade, first control means including, a control lever operatively connected to said subassembly means for pivoting same about said second pivot axis, whereby the saw blade is raised or lowered in said opening to a first elevation with respect to the tabletop in a relatively quick setting manner, and locking means for securing said control lever at a position corresponding to said first elevation setting for the saw blade, the locking means including, a split yoke disposed about said pivot means;

a control rod, a rotatable hand grip disposed upon said control lever, said control rod operatively connected between said split yoke and said rotatable hand grip such that said split yoke is secured to said pivot means when said grip is rotated in one direction and wherein said yoke is released from a secured connection to said pivot means when said grip is rotated in the opposite direction, said locking means proximately disposed to said control lever such that both are manipulatable by the same hand of the operator, without removing the hand from said lever throughout the complete elevation setting operation, second control means operatively connected to said subassembly means for pivoting said subassembly means about said second pivot axis independently of said control lever, said second control means providing a further elevation adjustment of the saw blade, and means for pivoting said assembly means about said first pivot axis, whereby the angle of the saw blade relative to said tabletop is varied.

36. A power tool apparatus comprising:

a housing including a tabletop having an opening through which a motor-driven tool can pass;

assembly means pivotally mounted in said housing about a first pivot axis, said assembly means including, pivot means defining a second pivot axis and fixedly connected to said assembly means, subassembly means pivotally mounted on said pivot means and including the tool, control means including, a control lever operatively connected to said subassembly means for pivoting same about said second pivot axis, whereby the tool is raised or lowered in said opening to a desired elevation with respect to the tabletop in a relatively quick setting manner, and locking means for securing said control lever at a position corresponding to said desired elevation setting for the tool, the locking means including, a split yoke disposed about said pivot means, a control rod, a rotatable hand grip disposed upon said control lever, said control rod operatively connected between said split yoke and said rotatable hand grip such that said split yoke is secured to said pivot means when said grip is rotated in one direction and wherein said yoke is released from a secured connection to said pivot means when said grip is rotated in the opposite direction, said locking means proximately disposed to said control lever such that both are manipulatable by the same hand of the operator, without removing the hand from said lever throughout the complete elevation setting operation, and means for pivoting said assembly means about said first pivot axis, whereby the angle of the tool relative to said tabletop is varied.

37. A power tool apparatus comprising:

a housing including a tabletop having an opening through which a motor-driven tool can pass, assembly means pivotally mounted in said housing about a first pivot axis, said assembly means including, pivot means defining a second pivot axis and fixedly connected to said assembly means, subassembly means pivotally mounted on said pivot means and including the tool, first control means including, a control lever operatively connected to said subassembly means for pivoting same about said second pivot axis, whereby the tool is raised or lowered in said opening to a first elevation with respect to the tabletop in a relatively quick setting manner, and locking means for securing said control lever at a position corresponding to said first elevation setting for the tool, the locking means including, a split yoke disposed about said pivot means, a control rod, a rotatable hand grip disposed upon said control lever, said control rod operatively connected between said split yoke and said rotatable hand grip such that said split yoke is secured to said pivot means when said grip is rotated in one direction and wherein said yoke is released from a secured connection to said pivot means when said grip is rotated in the opposite direction, said locking means proximately disposed to said control lever such that both are manipulatable by the same hand of the operator, without removing the hand from said lever throughout the complete elevation setting operation, second control means operatively connected to said subassembly means for pivoting said subassembly means about said second pivot axis independently of said control lever, said second control means providing a further elevation adjustment of the tool, and means for pivoting said assembly means about said first pivot axis, whereby the angle of the tool relative to said tabletop is varied.

38. A power tool apparatus comprising:

a housing including a tabletop having an opening through which a motor-driven tool can pass;

assembly means pivotally mounted in said housing about a first pivot axis, said assembly means including, pivot means defining a second pivot axis and fixedly connected to said assembly means, subassembly means pivotally mounted on said pivot means and including the tool, first control means including, a control lever operatively connected to said subassembly means for pivoting same about said second pivot axis, whereby the tool is raised or lowered in said opening to a first elevation with respect to the tabletop in a relatively quick setting manner, and locking means for securing said control lever at a position corresponding to said first elevation setting for the tool, said locking means proximately disposed to said control lever such that both are manipulatable by the same hand of the operator, without removing the hand from said lever throughout the complete elevation setting operation, second control means operatively connected to said subassembly means for pivoting said subassembly means about said second pivot axis independently of said control lever and providing a further elevation adjustment of the tool, the second control means having, a leaf spring disposed along the length of said control lever, hub means disposed at one end of said control lever and fixedly connected to one end of said leaf spring, the remaining end of said leaf spring fixedly connected to said respective subassembly, means for urging said hub means axially along said control lever arm, whereby the stress developed in said leaf spring is transmitted through its operative connection to said respective subassembly to cause pivoting thereof about said second pivot axis, and means for pivoting said assembly means about said first pivot axis, whereby the angle of the tool relative to said table top is varied.

39. A power tool apparatus comprising:

a housing including a tabletop having an opening through which a motor-driven tool can pass;

assembly means pivotally mounted in said housing about a first pivot axis, said assembly means including, pivot means defining a second pivot axis and fixedly connected to said assembly means, subassembly means pivotally mounted on said pivot means and including the tool, control means including, a control lever operatively connected to said subassembly means for pivoting same about said second pivot axis, whereby the tool is raised or lowered in said opening to a desired elevation with respect to the tabletop in a relatively quick setting manner, and locking means for securing said control lever at a position corresponding to said desired elevation setting for the tool, the control lever operatively connected to the assembly means to pivot the assembly means about said first pivot axis, whereby the angle of the tool relative to said tabletop is varied, and said locking means proximately disposed to said control lever such that both are manipulatable by the same hand of the operator, without removing the hand from said lever throughout the complete elevation setting operation.

40. A power tool apparatus comprising:

a housing including a tabletop having an opening through which a motor-driven tool can pass;

assembly means pivotally mounted in said housing about a first pivot axis, said assembly means including, pivot means defining a second pivot axis and fixedly connected to said assembly means, subassembly means pivotally mounted on said pivot means and including the tool, first control means including, a control lever operatively connected to said subassembly means for pivoting same about said second pivot axis, whereby the tool is raised or lowered in said opening to a first elevation with respect to the tabletop in a relatively quick setting manner, and locking means for securing said control lever at a position corresponding to said first elevation setting for the tool, the control lever operatively connected to the assembly means to pivot the assembly means about said first pivot axis, whereby the angle of the tool relative to said tabletop is varied, said locking means proximately disposed to said control lever such that both are manipulatable by the same hand of the operator, without removing the hand from said lever throughout the complete elevation setting operation, second control means operatively connected to said subassembly means for pivoting said subassembly means about said second pivot axis independently of said control lever, and said second control means providing a further elevation adjustment of the tool.

41. A power tool apparatus comprising:

a housing including a tabletop having an opening through which a motor-driven tool can pass;

assembly means pivotally mounted in said housing about a first pivot axis, said assembly means including, pivot means defining a second pivot axis and fixedly connected to said assembly means, subassembly means pivotally mounted on said pivot means and including the tool, and control means including, a control lever operatively connected to said subassembly means for pivoting same about said second pivot axis, whereby the tool is raised or lowered in said opening to a desired elevation with respect to the tabletop in a relatively quick setting manner, and locking means for securing said control lever at a position corresponding to said desired elevation setting for the tool, the control lever operatively connected to the assembly means to pivot the assembly means about said first pivot axis, whereby the angle of the tool relative to said tabletop is varied, said locking means proximately disposed to said control lever such that both are manipulatable by the same hand of the operator, without removing the hand from said lever throughout the complete elevation setting operation, and means for locking said assembly means to said housing at the desired angle of the tool relative to the tabletop.

42. A power tool apparatus comprising:

a housing including a tabletop having an opening through which a motor-driven tool can pass;

assembly means pivotally mounted in said housing about a first pivot axis, said assembly means including, pivot means defining a second pivot axis and fixedly connected to said assembly means, subassembly means pivotally mounted on said pivot means and including the tool, first control means including, a control lever operatively connected to said subassembly means for pivoting same about said second pivot axis, whereby the tool is raised or lowered in said opening to a first elevation with respect to the tabletop in a relatively quick setting manner, and locking means for securing said control lever at a position corresponding to said first elevation setting for the tool, the control lever operatively connected to the assembly means to pivot the assembly means about said first pivot axis, whereby the angle of the tool relative to said tabletop is varied, said locking means proximately disposed to said control lever such that both are manipulatable by the same hand of the operator, without removing the hand from said lever throughout the complete elevation setting operation, second control means operatively connected to said subassembly means for pivoting said subassembly means about said second pivot axis independently of said control lever, said second control means providing a further elevation adjustment of the tool, and means for locking said assembly means to said housing at the desired angle of the tool relative to the tabletop.

43. A table saw comprising:

a housing including a tabletop having an opening through which a motor-driven saw blade can pass;

assembly means pivotally mounted in said housing about a first pivot axis, said assembly means including, pivot means defining a second pivot axis and fixedly connected to said assembly means, subassembly means pivotally mounted on said pivot means and including the saw blade, control means including, a control lever operatively connected to said subassembly means for pivoting same about said second pivot axis, whereby the saw blade is raised or lowered in said opening to a desired elevation with respect to the tabletop in a relatively quick setting manner, and locking means for securing said control lever at a position corresponding to said desired elevation setting for the saw blade, the locking means including, a split yoke disposed about said pivot means, a control rod, a rotatable hand grip disposed upon said control lever, said control rod operatively connected between said split yoke and said rotatable hand grip such that said split yoke is secured to said pivot means when said grip is rotated in one direction and wherein said yoke is released from a secured connection to said pivot means when said grip is rotated in the opposite direction, said locking means proximately disposed to said control lever such that both are manipulatable by the same hand of the operator, without removing the hand from said lever throughout the complete elevation setting operation, and means for pivoting said assembly means about said first pivot axis, whereby the angle of the saw blade relative to said tabletop is varied.

44. An adjusting mechanism for a power-driven tool having a housing with a tabletop comprising:

an elevation pivot means mounted in the housing along an elevation pivot axis, a tool connected to the elevation pivot means and pivotable about the elevation pivot axis, coarse adjustment means connected to the tool to selectively pivot the tool about the elevation pivot axis to a first coarse elevation with respect to the tabletop, locking means connected to the coarse adjustment means and engageable to maintain the tool at the first coarse elevation, vernier adjustment means operable upon engagement of the locking means, and the vernier adjustment means connected to the tool to selectively pivot the tool about the elevation pivot axis to a fine elevation setting relative to the first coarse elevation, and being operative independently of the coarse adjustment means.

45. The combination claimed in claim 44 wherein: the coarse adjustment means comprises a control lever connected to the tool, and the locking means engageable from the control lever.

46. The combination claimed in claim 45 wherein:

the locking means comprises a split hub releasably attached to the pivot means, the split hub threadedly connected to one end of an elongated member mounted adjacent the control lever, and the other end of the elongated member connected to a handle rotatably mounted on the control lever, whereby rotation of the handle in one direction compresses the hub upon the pivot means.

47. The combination claimed in claim 46 wherein the tabletop lies in a plane, and the elevation of the tool with the locking means disengaged is normally below the plane of the tabletop, whereby the tool does not protrude above the tabletop in the absence of external force exerted upon the control lever.

48. The combination claimed in claim 47 wherein the vernier adjustment means is adjusted from the control lever.

49. The combination claimed in claim 48 wherein:

the control lever has a hub mounted thereon, the vernier adjustment means comprises bias means having a first end and a second end, the bias means connected at the first end to the tool and at the second end to the control lever hub, and the control lever hub is selectively axially moveable along the control lever to vary the compression of the bias means, whereby the tool is pivoted about the elevation pivot axis.

50. The combination claimed in claim 49 wherein:

a vernier hub is slideably mounted on the elevation pivot means adjacent the split hub, the vernier hub is connected to the tool, and the first end of the bias means is connected to the vernier hub, whereby compression of the bias means pivots the vernier hub and the tool about the elevation pivot axis.

51. The combination claimed in claim 50 wherein the bias means is an elongated member.

52. The combination claimed in claim 50 wherein:

a bevel angle pivot means is mounted into the housing along a bevel angle pivot axis, the elevation pivot means is fixedly attached to the bevel angle pivot means, and a bevel angle adjustment means is connected to the tool selectively to pivot the tool about the bevel angle pivot axis, whereby the angle between the tool and the tabletop is varied.

53. The combination claimed in claim 52 wherein the bevel angle adjustment means comprises the control lever.

* * * * *